United States Patent [19]

Yang

[11] 4,134,737

[45] Jan. 16, 1979

[54] PROCESS FOR PRODUCING HIGH-PURITY COAL

[75] Inventor: Ralph T. Yang, Middle Island, N.Y.

[73] Assignee: Aluminum Company of America, Pittsburgh, Pa.

[21] Appl. No.: 654,355

[22] Filed: Feb. 2, 1976

Related U.S. Application Data

[63] Continuation-in-part of Ser. No. 510,360, Sep. 30, 1974, abandoned.

[51] Int. Cl.[2] ..... C10L 9/10; C10B 57/00

[52] U.S. Cl. ..... 44/1 R; 201/17

[58] Field of Search ..... 44/1 R; 201/17; 75/6

[56] References Cited

U.S. PATENT DOCUMENTS 3,393,978 7/1968 Murphy et al. ..... 201/17 X

FOREIGN PATENT DOCUMENTS 1800070 5/1970 Fed. Rep. of Germany ..... 201/17

OTHER PUBLICATIONS

Reggel et al, Preparation of Ash-Free, Pyrite-Free Coal by Mild Chemical Treatment, ACS, Div. of Fuel Preprints, vol. 17, pp. 44–48 (1972).

*Primary Examiner*—Carl Dees

*Attorney, Agent, or Firm*—David J. Hill; John P. Taylor

[57] ABSTRACT

High-purity coal useful in the production of high-purity carbon is produced by treating coal to remove the impurities therein. The coal, which may be subject to conventional pretreatment processes such as beneficiation processes or the like, digested in a caustic solution to solubilize certain of the impurities in the coal and to chemically react with other impurities to form acid soluble products. The digested coal is then filtered to separate the partially purified coal from the caustic and soluble impurities dissolved therein. The coal is then treated with a mineral acid to dissolve the acid soluble products contained in the coal. Finally, the coal is subjected to a nitric acid treatment to remove metal sulfides. The resultant high-purity carbon contains less than 0.1% by weight ash or metal sulfides.

7 Claims, 1 Drawing Figure

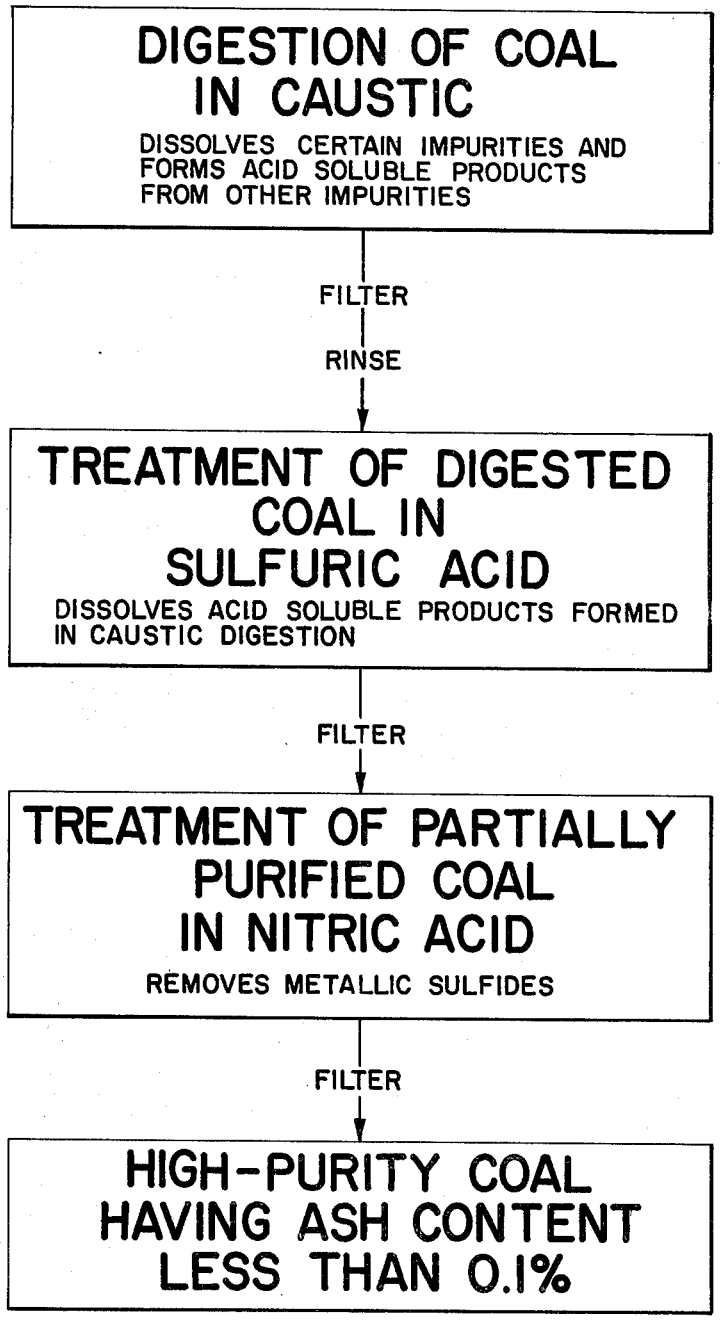
DIGESTION OF COAL IN CAUSTIC
DISSOLVES CERTAIN IMPURITIES AND FORMS ACID SOLUBLE PRODUCTS FROM OTHER IMPURITIES
FILTER
RINSE
TREATMENT OF DIGESTED COAL IN SULFURIC ACID
DISSOLVES ACID SOLUBLE PRODUCTS FORMED IN CAUSTIC DIGESTION
FILTER
TREATMENT OF PARTIALLY PURIFIED COAL IN NITRIC ACID
REMOVES METALLIC SULFIDES
FILTER
HIGH-PURITY COAL HAVING ASH CONTENT LESS THAN 0.1%

PROCESS FOR PRODUCING HIGH-PURITY COAL

CROSS-REFERENCE TO RELATED APPLICATIONS

This application is a continuation-in-part of U.S. patent application Ser. No. 510,360, filed Sept. 30, 1974 and now abandoned.

BACKGROUND OF THE INVENTION

This invention relates to the production of highpurity carbon by the purification of coal.

In recent years, much attention has been given to the purification of coal for metallurgical or environmental reasons. Simpler schemes for removing a majority of the impurities involve beneficiation processes such as a flotation process which may reduce the impurity level down to about 1–3%. Literature sources indicate that at least experimental work has been carried out toward further reduction of the impurities by a caustic digest followed by an acid treatment. [The Preparation of Ultra-Clean Coal in Germany, by A. Crawford, *Transactions — The Institute of Mining Engineers,* Volume 111, pages 204–19 (1951–1952); The Action of Alkalies on Low-Rank Coals, by J. D. Brooks and S. Sternhell, *Fuel,* Volume 37, pages 124–125 (1958); Coal as a Source of Electrode Carbon in Aluminum Production, by R. J. Campbell, Jr., R. J. Fulton and C. L. Boyd, *Bureau of Mines Reported Investigations* 5191, (1956); Preparation of Ash-Free, Pyrite-Free Coal by Mild Chemical Treatment, by L. Reggel, R. Raymond, I. Wender and B. D. Blaustein, *ASC, Division of Fuel Preprints,* Volume 17 (1), pages 44–48 (1972)] While in each of the above articles a coal is produced which is considerably purer than the starting material, none of the references reports production of a purified material containing less than 0.1% ash. Furthermore, the reduction of other undesirable impurities, such as sulfur, to levels below 1.5% total sulfur and preferably substantial elimination of pyritic sulfur (sulfides of iron) is also desired but apparently unobtainable using prior art processes such as described, for example, in the aforesaid Reggel et al article. Such a high level of purity is required for example for use as carbon aggregate in aluminum smelting anodes.

In the article by Crawford the coal was subjected to a 3% caustic digest at 250° C. for 20 minutes followed by a 5% HCL treatment to reduce the ash content from 0.8 to 0.28%. Brooks et al subject the coal to a caustic treatment at 190° C. for 12 hours followed by unidentified acidification. A level of 0.1% is reported for one particular sample of coal. Other samples are reported at 0.3% final ash content. Campbell et al report that a 0.2 content ash level was achieved by subjecting a beneficiated coal to a combination sodium hydroxide and butyl alcohol digest at 125° C. for 2 hours followed by an acid treatment in either hydrochloric acid, sulfuric acid, $CO_2$ or $SO_2$. The ash content was reported to be reduced to 0.7%.

While the foregoing treatments undoubtedly represent progress in the art toward lowering the content of impurities such as, for example, sulfur, to acceptable environmental levels for combustion purposes and even for some metallurgical purposes, there still remains a need for a process to produce an even higher purity carbon for use, for example, in aluminum smelting anodes. It is therefore an object of this invention to provide a treatment for the purification of coal which will lower the ash content of the coal to less than 0.1%.

SUMMARY OF THE INVENTION

In accordance with the invention, coal, which preferably has been subjected to a previous beneficiation step to lower the ash content to about 3–5%, is subjected to a three-step purification in which the coal is first digested in a caustic solution to solubilize at least a portion of the impurities and to react the caustic with other impurities to form acid soluble products followed by a first treatment of the digested coal in a mineral acid such as sulfuric acid to dissolve the acid soluble products followed by subsequent treatment in nitric acid to remove metallic sulfide impurities remaining in the coal.

BRIEF DESCRIPTION OF THE DRAWING

The sole drawing of the invention is a flowsheet illustrating the process of the invention.

DESCRIPTION OF THE PREFERRED EMBODIMENTS

In accordance with the invention, coal is purified by a first caustic digest step followed by two subsequent acid treatment steps. Preferably the coal, prior to subjection to such steps, is subject to an initial beneficiation or mechanical separation such as by a flotation process such as is well known to those skilled in the art to reduce the impurities in the coal down to about 3–5% ash content.

Prior to subjection to the caustic digest, the coal is ground and screened to remove coarse particles such as particles in the size range of about above 28 mesh to provide a particle size of roughly from about 28 mesh down to about 80% above 400 mesh. Preferably the particle size is −35 mesh and most preferably −100 mesh to provide maximum surface area for the digest. The only limit on the finer particle size are those limits which would be placed thereon by any restraints in the ability of the filtration equipment to filter the fines or any safety problems which might be encountered by an excessive amount of easily oxidizable fine particles, i.e., greater than 20% −400 mesh size.

The caustic solution for the digest is preferably an NaOH solution having a concentration of at least about 3%. Higher concentrations of up to 10, 20 or even 30% may, of course, be used. However, it has been found that concentrations above about 10 or 15% are usually not necessary to achieve a satisfactory digest. The temperature may be as low as about 120°–140° C. and may be as high as 230° C. Even higher temperatures, up to 400° C. or higher, can, of course, be used but such temperatures may well prove to be uneconomical with regard to any savings in digest time. The digest is carried out for a period of time which may vary from about 10 minutes to several hours, depending upon the temperature of the digest and the concentration of the caustic solution.

The ratio of the solution to solids which as used herein are in parts by weight has been found to also affect the overall digest reaction rate. A ratio of 6 parts of caustic solution to 1 part solid can be used if a sufficient temperature and time period are allotted as well as sufficient concentration. For example, a ratio of 2 parts of a 3% caustic solution to 1 part coal may be used at a digest temperature of 140° C. if a sufficient digest time period is provided which may, for example, be several hours. The interrelationship of these parameters will, of course, be recognized by those skilled in the art and various optimums worked out depending upon the suitability of the particular apparatus such as, for example, the cost of the caustic, the availability of suitable heating apparatus to reach certain temperatures with regard to the pressures which will be encountered at such temperatures as well as the total volume available with regard to the desired overall digest time period.

Following the digest, the slurry is filtered to separate the caustic and dissolved impurities therein from the partially purified coal. The filtered coal is then rinsed, for example, in water to remove any remaining amounts of caustic. While such a rinse is not absolutely necessary, it does remove additional caustic as well as dissolved impurities and, more importantly, provides an economical benefit in that any caustic residues will have to be neutralized by acid, thus requiring additional amounts of acid to be used if the rinse is eliminated.

The digested coal is now subject to a treatment in mineral acid. Preferably, from the standpoint of economics, the mineral acid comprises sulfuric acid. Other acids, however, such as for example, hydrochloric acid could be used. The sulfuric acid treatment results in the recovery of soluble sulfates and thiols from organic sulfides in the coal which reacted with the sodium in the caustic digest. Furthermore, the sulfuric acid reacts with the desilication products formed by reaction between the caustic and aluminas and silicas present in the coal resulting in soluble aluminum sulfate and sodium sulfate salts as well as silicic acids. Furthermore, metallic sulfides oxidized in the caustic digest step such as, for example, iron sulfide oxidized to iron oxide, reacts with the sulfuric acid to form soluble iron sulfate. Other oxides which might be present such as titanium oxide, magnesium oxide or the like can also be reacted in this step to form the corresponding sulfate.

In accordance with the invention, the sulfuric acid digest is carried out for at least about 15 minutes and preferably for about 20 minutes at a temperature of at least about 40° C. and preferably about 70°–80° C. The concentration of the sulfuric acid is at least about 4% although stronger concentrations can be used, particularly if the lower temperatures and shorter reaction times are desired. The ratio of the sulfuric acid solution to the coal is at least about 2 parts solution to 1 part solid and preferably about 2.5 parts of solution to solid. Naturally, of course, higher ratios as well as higher temperatures, acid concentrations, or reaction times could be used but these may prove to be less economical and probably unnecessary. Following the digest, the slurry is again filtered to remove the acid treated coal solids from the sulfuric acid and dissolved impurities. Rinsing following this step is optional to remove further sulfuric acid and impurities but is not necessary from a standpoint of economics since the third step was also an acid step and thus there will be no neutralization of acid residues.

In accordance with the invention, it has been found that the preceding caustic and acidic steps, while greatly reducing the overall ash content, still do not provide a level of purity required to produce, for example, high-purity anode grade carbon. While I do not wish to be bound by any theory of operation, it would appear that the presence of metallic sulfides such as, for example, iron sulfide (pyrite) in the coal which are not completely oxidized by the caustic step nor removed in the preceding acid treatment may be the major source of the remaining ash residues. Such metallic sulfides may be removed by treatment of the semi-purified coal with a nitric acid solution. A digest in dilute nitric acid at a moderate temperature will result in the formation of soluble nitrates of the corresponding metal sulfide together with hydrogen sulfide and elemental sulfur. Under higher concentration and temperature a sulfate will be formed together with sulfuric acid.

In accordance with the invention, a nitric acid concentration of at least 5% is used. However, the concentration may be as high as 20–30% if necessary. The reaction time is carried out for at least 30 minutes and may be as long as several hours if necessary. The reaction temperature is at least 70° C. Higher temperatures as well may be used. The ratio of solution to coal is at least about 4.0 acid solution to 1 part coal. Preferably, the ratio is from 6–10 parts of acid solution to 1 part of coal. While it is preferred to conduct the acid treatments in two independent steps, it is contemplated that the two steps could be combined into one by using a combination of sulfuric or hydrochloric acid with nitric acid if the economics of conserving tank space and reaction time surmount the added reagent costs.

Following this acid treatment, the coal is again filtered to remove the nitric acid and impurities dissolved therein. The filtered coal is then washed and then may be analyzed to determine the final ash and sulfur content as well as the iron and silicon content (the major sources of impurities in most coals). Such chemical analysis may be carried out using x-ray diffraction, atomic absorption spectrometry, or other more conventional wet chemical methods. An ash content of less than 0.1% by weight, together with respective iron and silicon contents of less than 0.1% by weight and a total sulfur content (including organic sulfur) of less than 1.5% by weight and less than 0.1% by weight pyritic sulfur would be considered to be useful as anode grade carbon.

EXAMPLE 1

To further illustrate the process of the invention, a sample of Illinois No. 6 seam coal, previously beneficiated to an impurity content measured by an ash content of about 3.2%, was subjected to a caustic digest at a temperature of 190° C. for 35 minutes. The concentration of the sodium hydroxide was 10% and the ratio of the caustic solution to solids was 6 parts NaOH solution per 1 part of coal. Following the digest, the slurry was filtered and then rinsed using 4 parts water per part solids. The digested coal was then treated in a 5% concentration of sulfuric acid for 20 minutes at 80° C. The ratio of sulfuric acid solution to solids was 2.5. The acid treated coal was again filtered and washed in water and then subjected to a nitric acid treatment for 1 hour at 75° C. The concentration of the nitric acid was 18% and the ratio of the nitric acid solution to coal was 10 parts acid solution to 1 part solid. Following the nitric acid treatment, the coal slurry was filtered, thoroughly rinsed with water, and dried. The resultant purified coal was then analyzed for mineral content using x-ray diffraction and found to contain an iron content of 0.01% and a silicon content of 0.01%. The ash content of the coal as measured by the procedures of ASTM D-271 was found to be 0.05%.

EXAMPLE 2

A sample of Indiana No. 6 coal was treated as in Example 1. The resultant purified coal was analyzed for mineral content using x-ray diffraction and found to contain an iron content of 0.02 wt.% and a silicon content of 0.02 wt.%. Also, the coal after treatment was found to have a total sulfur of 1.35 wt.% and to be substantially free of pyritic sulfur, that is, less than 0.1 wt.%. Both sulfur determinations were made by wet chemical analysis. The ash content of the coal was 0.05 wt.% as measured by the procedures of ASTM D-271.

While the foregoing invention has been described in terms of preferred embodiments, and in terms of preferred reaction parameters, it will be obvious to those skilled in the art that moderate modifications in the process may be carried out without departing from the scope of the invention which is to be limited only by the scope of the appended claims.

What is claimed is:

1. A process for the production of high-purity coal to reduce or eliminate impurities therein which comprises:
   (a) digesting the coal in a caustic solution to solubilize at least a portion of said impurities and to react the caustic with other impurities to form acid soluble products;
   (b) separating the caustic solution and dissolved impurities from the coal;
   (c) treating the digested coal in a mineral acid other than nitric acid to dissolve said acid soluble products;
   (d) separating the treated coal from said mineral acid and impurities dissolved therein;
   (e) thereafter treating the coal with nitric acid to remove metallic sulfide impurities remaining in said coal; and
   (f) recovering a purified coal from said treatments characterized by having, by weight, respectively not more than 0.1% ash, 0.02% Fe, 0.02% Si, 1.5% total sulfur and 0.1% pyritic sulfur.

2. The process of claim 1 wherein said coal is screened and ground, when necessary, to a particle size not greater than 28 mesh.

3. The process of claim 2 wherein said particle size is 80% by weight above 400 mesh.

4. The process of claim 1 wherein the concentration of said caustic is at least 3% by weight, the ratio of caustic solution to coal is at least 2 parts by weight caustic solution per part by weight coal, the digest time is at least 10 minutes and the digest temperature is at least 120° C.

5. The process of claim 1 wherein said mineral acid is selected from the group consisting of sulfuric acid and hydrochloric acid, said acid has a concentration of at least 4% by weight, the ratio of acid solution to coal is at least 2 parts by weight acid solution per part of coal, and the treatment is carried out for at least 15 minutes at a temperature of at least 40° C.

6. The process of claim 1 wherein said nitric acid has a concentration of at least 5% by weight, the ratio of nitric acid solution to coal is at least 4 parts by weight nitric acid per part by weight of coal and the treatment is carried out for at least 30 minutes at a temperature of at least 70° C.

7. A process for the production of high-purity coal useful for producing high-purity carbon therefrom which comprises:
   (a) grinding coal to a particle size of from 28 mesh to at least 80% by weight above 400 mesh;
   (b) digesting the coal in an at least 3% by weight sodium hydroxide solution at a ratio of at least 2 parts by weight sodium hydroxide solution per part by weight coal to solubilize at least a portion of the impurities in the coal and to react with other impurities in the coal to form acid soluble products;
   (c) separating the digested coal from the sodium hydroxide solution and impurities dissolved therein;
   (d) treating the digested coal with an at least 4% by weight sulfuric acid solution at a solution to solids ratio of at least 2 parts by weight sulfuric acid solution per part by weight of coal to dissolve at least a portion of acid soluble impurities in the coal;
   (e) separating the treated coal from the sulfuric acid solution and impurities dissolved therein;
   (f) treating the coal with an at least 5% by weight nitric acid solution at a solution to solids ratio of at least 4 parts by weight nitric acid solution per part by weight coal; and
   (g) separating the coal from the nitric acid and impurities dissolved therein;

said sodium hydroxide digest, sulfuric acid treatment and nitric acid treatment being carried out at temperatures and time periods sufficient to provide a purified coal having, by weight, not more than 0.1% ash, 0.02% Fe, 0.02% Si, 1.35% total sulfur and 0.1% pyritic sulfur.

* * * * *